US005317848A

United States Patent [19]

Abbey

[11] Patent Number: 5,317,848

[45] Date of Patent: Jun. 7, 1994

[54] MODULAR, PRECAST CORNER PANELS

[76] Inventor: Jay E. Abbey, 416 Port Rd., Binghamton, N.Y. 13901

[21] Appl. No.: 727,717

[22] Filed: Aug. 8, 1991

Related U.S. Application Data

[63] Continuation of Ser. No. 345,070, Apr. 28, 1989, abandoned.

[51] Int. Cl.[5] ..... E04B 1/04; E04C 2/04

[52] U.S. Cl. ..... 52/284; 52/610; 52/630

[58] Field of Search ..... 52/250, 254, 602, 610, 52/279, 284, 285, 382, 585, 630; D25/113, 125

[56] References Cited

U.S. PATENT DOCUMENTS

| | | | |
|---|---|---|---|
| 540,501 | 6/1895 | Lanyon | 52/582 |
| 2,043,697 | 6/1936 | Deichmann | 52/602 |
| 2,061,281 | 11/1936 | Lawlor | 52/582 |
| 2,071,039 | 2/1937 | Leemhuis | 52/582 |
| 2,202,745 | 5/1940 | Muse | 52/582 |
| 3,562,989 | 2/1971 | Gregoire | 52/279 |
| 3,979,863 | 9/1976 | Hurley et al. | 52/583 |
| 4,003,172 | 1/1977 | Pawl | 52/610 |

FOREIGN PATENT DOCUMENTS

| | | | |
|---|---|---|---|
| 710034 | 5/1965 | Canada | 52/585 |
| 537339 | 6/1941 | United Kingdom | 52/602 |

*Primary Examiner*—Michael Safavi
*Attorney, Agent, or Firm*—Salzman & Levy

[57] ABSTRACT

A precast, waffle corner panel is featured for modular construction of buildings and edifices. The corner panel maintains dimensional incrementing in wall construction previously lost by the practice of overlapping two adjacent walls to form a corner. All connections and securements are achieved within the interior framework of the panel.

14 Claims, 6 Drawing Sheets

MODULAR, PRECAST CORNER PANELS

This is a continuation of co-pending application Ser. No. 07/345,070 filed on Apr. 28, 1989, now abandoned.

FIELD OF THE INVENTION

This invention relates to modular construction of buildings, edifices and dwellings utilizing precast waffle panels, and more particularly to a precast corner panel for such construction that allows for incremental dimensioning of the walls, and which uses standard nut and bolt attachment to side panels within the inner framework of the corner panel.

BACKGROUND OF THE INVENTION

The use of precast panels for modular construction of buildings is well known. Three different construction systems using solid precast panels are shown in U.S. Pat. Nos. 1,924,801; issued: Aug. 29, 1933; 2,078,144; issued: Apr. 20, 1937; and 3,685,241; issued: Aug. 22, 1972.

These aforementioned patents teach various methods for attaching corner panels to side panels. Amongst these methods are the hanging of the wall panels by means of eyelet fasteners and hooks (U.S. Pat. No. 2,078,144); and nut and bolt fasteners (U.S. Pat. No. 1,924,801).

Of the three methods, the most popular fastening system is the nut and bolt technique, which is commonly in use today with precast waffle panels.

Waffle panels have recently become popular because of their light weight, yet rigid construction provided by internal reinforcing ribs. These waffle panels find particular applicability in the construction of utility structures and multi story masonry buildings.

The corners for waffle constructed buildings are presently achieved by overlapping the ends of adjoining side wall panels. For some strange reason, no one has seen fit to cast a special corner panel for waffle structure.

While the overlapping of the side panels is adequate in providing a workable corner construction, certain problems exist with this technique:

1. When two standard eight inch (8") panels overlap a panel of even length, the resultant wall does not maintain the desired two foot (2') incremental dimension. Special, non-standard panels become necessary to maintain proper dimensioning, thus adding time, complexity and expense to what is ordinarily a simple procedure.

2. The overlap is void of a corner reinforcement (internal vertical) rib upon which furring strips for interior finishing can be hung.

3. The attachment bolt passes through the waffle recess of the overlapping panel, which creates a weak area of attachment.

4. The nut attaching to the bolt is only possible on the outside of the panel, thus creating an unsightly protuberance on an otherwise smooth wall. In addition, the through hole creates a potential spot for ground water leakage through foundation walls. For this reason, among others, precast waffle panels have not been widely used in foundation construction.

5. With the overlap technique, the space between adjoining panels, useful for providing for expansion and contraction therebetween, will vary and create a problem wherein shims are required for proper joint widths, thus producing uneven compression in the joint seal.

The present invention seeks to eleviate all of the above drawbacks by providing a precast waffle corner panel. The corner panel of this invention has reinforcing ribs that define the internal recess wherein a bolt and nut can provide fastening between a corner and side panel from the inside.

SUMMARY OF THE INVENTION

The invention features a precast, waffle corner panel for attachment to waffle side panels in the modular construction of buildings, edifices, dwellings, foundations and the like. The corner panel is capable of maintaining incremental dimensioning along walls of the building or foundation being erected.

The corner panel comprises an outer skin layer and inner reinforcement ribs including peripheral or side ribs having means defining a bolt hole for facilitating the attachment to the side panels in a comparable fashion as used to attach each of several side panels to themselves to produce a length of wall.

In this way, the corner panel is attached utilizing the same procedure used in the rest of the construction.

The ribs are tapered to provide reinforcement strength and produce a trapezoidal-shaped recess which makes the panel easily removed from the mold.

It is an object of this invention to provide a corner panel for modular waffle construction.

It is another object of the invention to provide a precast waffle corner panel that can be attached to side panels within an inner framework of the corner panel.

It is a further object of this invention to provide a corner panel for waffle construction that maintains the incremental dimensioning along the walls of the edifice being erected.

It is a further object of this invention to provide a mechanism by which waffle panels can be used particularly in the construction of foundations.

These and other objects of the invention will be better understood and will become more apparent with reference to the subsequent detailed description considered in conjunction with the accompanying drawings.

DESCRIPTION OF THE PREFERRED EMBODIMENT

Generally speaking, the invention pertains to a precast waffle corner panel for modular construction that enhances the use of waffle panels by fastening easily to side walls and providing a strong connecting joint therebetween.

For the sake of brevity, like elements shall bear the same numerical designation throughout the figures.

Figure 1:
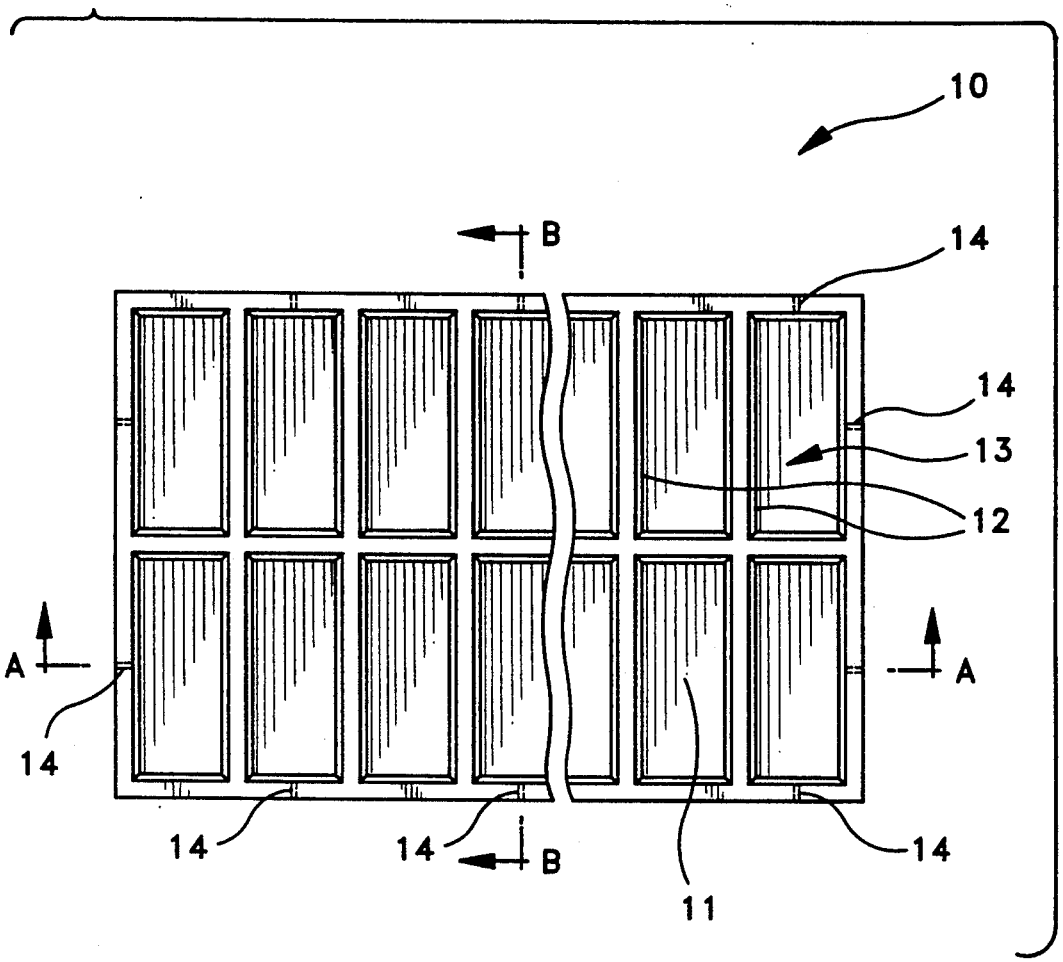
FIG. 1 is a plan view of a typical waffle side panel used in the construction of the foundation shown in FIG. 1.
Figure 1A:
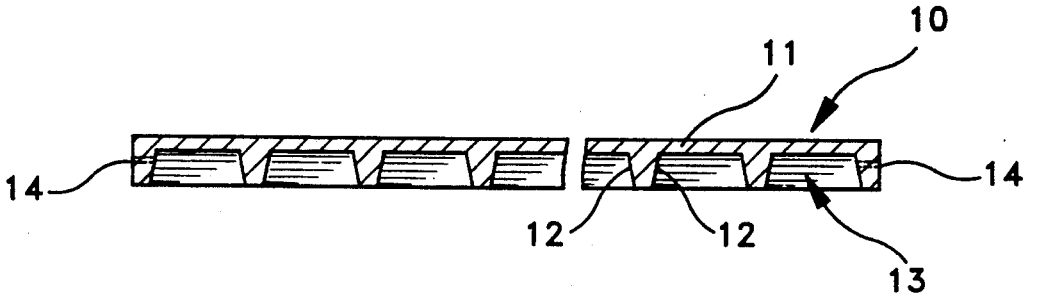
FIG. 1*a* is a sectional view of FIG. 1 taken along lines A—A.
Figure 1B:
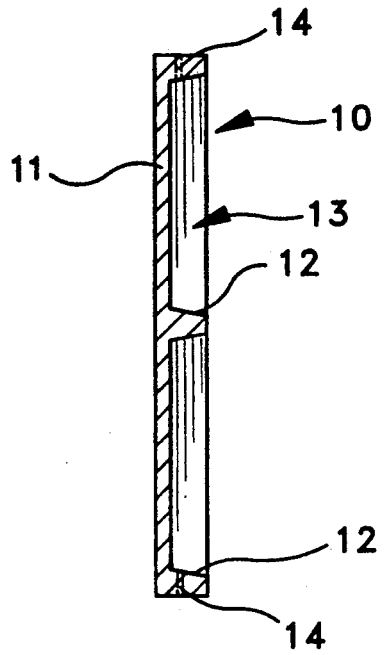
FIG. 1*b* is a sectional view of FIG. 1 taken along lines B—B.

Now referring to FIGS. 1, 1*a* and 1*b*, a typical side panel 10 for waffle, modular construction is shown. The side panel 10 is nominally 8 feet in height, 8 inches thick and varies in length in 2 foot increments. The side panel 10 can be cast using molding equipment readily available in the trade. It should be understood that the height of the inventive corner panel, described hereinbelow, can vary to be consistent with the height of side panels 10, which may be dimensions other than 8 feet.

The 8 inch thickness comprises a 2 inch skin 11 backed by 6 inch reinforcing ribs 12. The ribs 12 are tapered to provide recesses 13 of trapezoidal shape. The ribs have bolt holes 14 disposed therein to facilitate the attachment of the side panel 10 to other side panels 10, or to the inventive corner piece 20 (FIGS. 5, 5*a* and 5*b*), as will be explained hereinafter.

Figure 7:
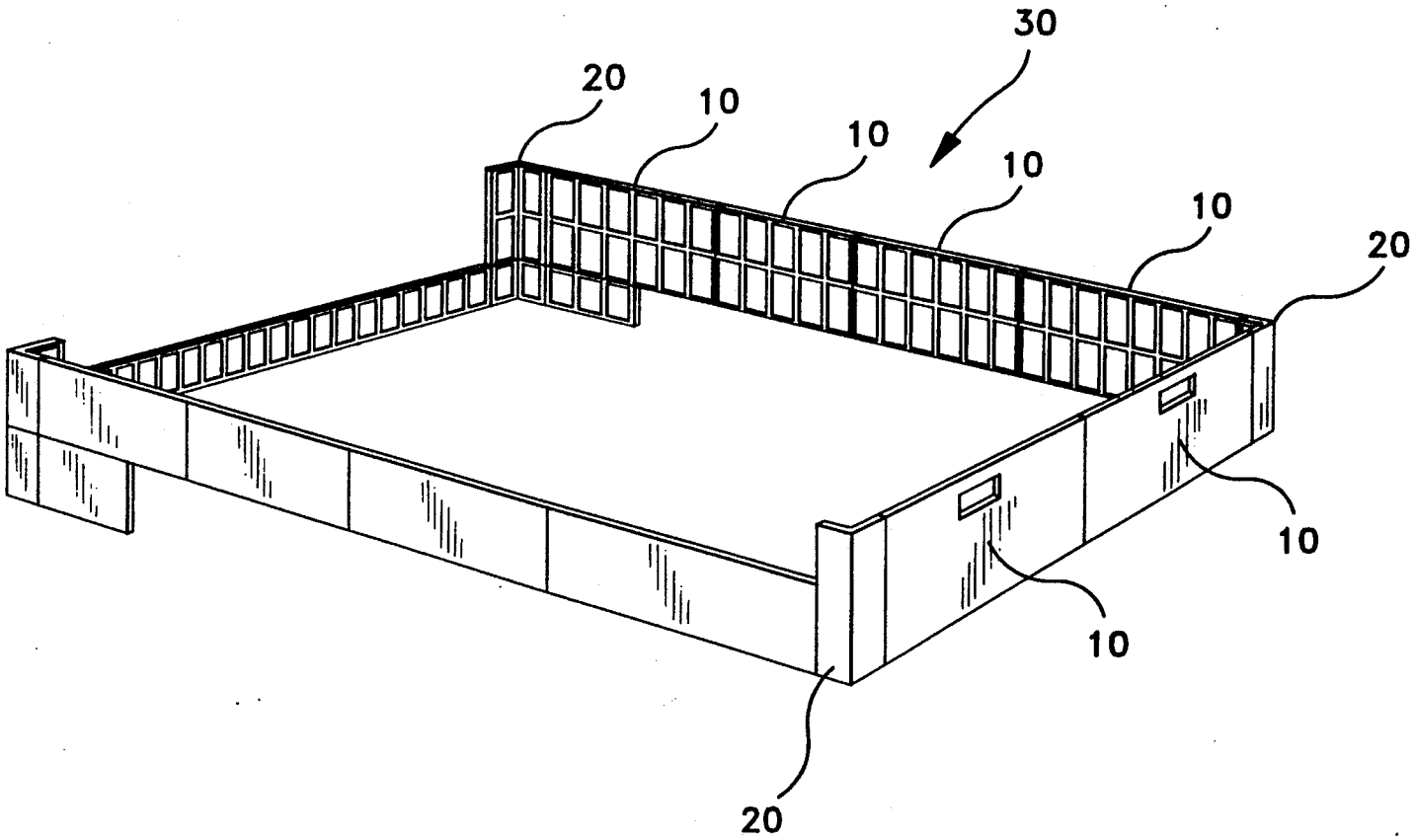
FIG. 7 is a perspective in situ view of a foundation constructed with the side panel shown in FIG. 1 and the inventive corner panel depicted in FIG. 5.

The tapered ribs 12 allow the side panel 10 to be removed from the mold easily during the casting process. The recesses 13 reduce the weight of the side panels 10, allowing them to be handled and installed easily. These side panels 10 are particularly suitable in the fabrication of foundations 30 (FIG. 7), multi-story masonry buildings and utility structures.

Figure 4:
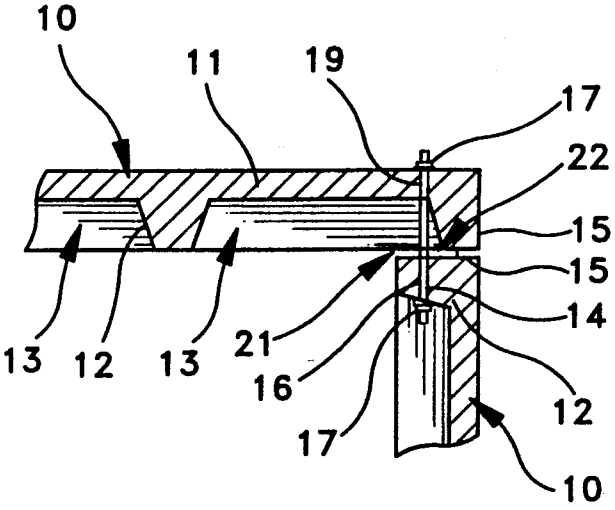
FIG. 4 is a sectional view of a bolted connection in corner construction.
Figure 3:
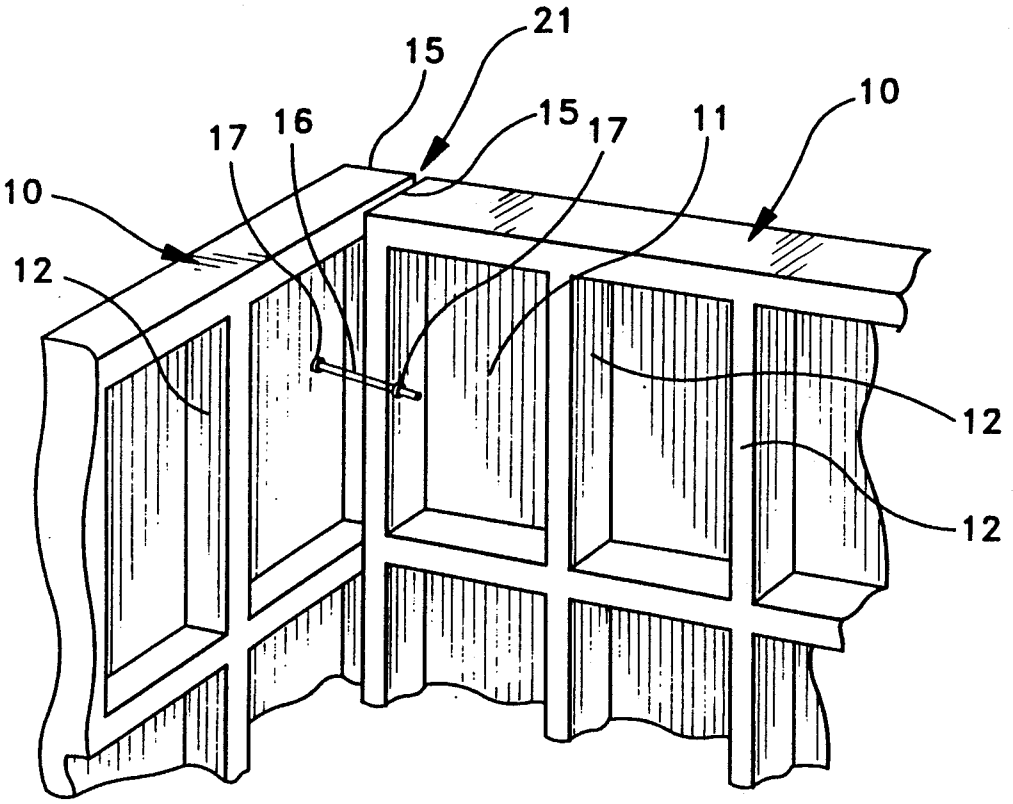
FIG. 3 is a perspective view of a prior art construction of a corner using overlapping side panels.

Before the advent of this invention, corners for these foundations 30 and other similar structures, were typically assembled by overlapping the ends 15 of the side panels 10, as shown in FIGS. 3 and 4.

The ends 15 of the side panels 10 were attached by passing a bolt 16 through the bolt hole 14 in rib 12 (FIG. 4) on end 15 of one side panel 10, and through the recess 13 and skin layer 11 of the adjoining side panel 10. The bolt 16 was then secured by end nuts 17, as shown.

One of the many problems created by this attachment procedure was that one of the nuts 17 was disposed on the outside of skin layer 11, which was unsightly.

Also, the hole 19 fabricated in the skin layer 11 created a potential for ground water leakage in the foundation. In addition, a substantial portion of bolt 16 was left unsupported by its passage through recess 13, thus creating a weak connection.

However, the most serious problem was the impairment of the dimensional increments that standard paneling provides. That is, the overlap reduced the wall length by 2 inches on one side. This unfortunate circumstance caused interior wooden beams to be cut to non-standard lengths, and varied the width of connection joints 21.

Side panels 10 are usually cast to a length equal to $\frac{3}{8}$" less than nominal size to accommodate an annular space for the placement of seals 22, as well as to accommodate for expansion and contraction.

However, the 2 inch overlap creates a condition where the joint width will vary depending upon the number of side panels 10, since the 2 inch difference must be absorbed by the number of joints in the wall section. That is, each joint will increase in width an equal share with its companion joints to make up the 2 inch difference.

Thus, two panel joints 22 would increase by $\frac{3}{4}$", three panel joints 22 would increase by 9/16", and four joints by $\frac{1}{2}$".

The varying joint sizes creates a shimming problem as well as uneven expansion and contraction forces in that wall portion of the foundation.

The end connection so created thus destroys the very uniformity and convenience of construction that standard panels are intended to provide.

Figure 2:
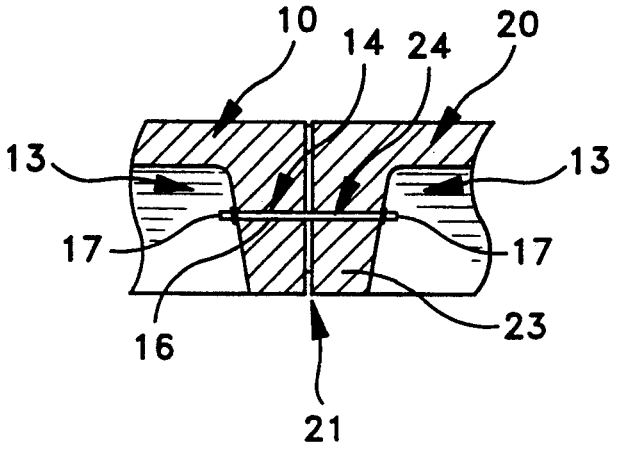
FIG. 2 is an enlarged sectional view of a typical bolted connection for attaching panels.
Figure 5A:
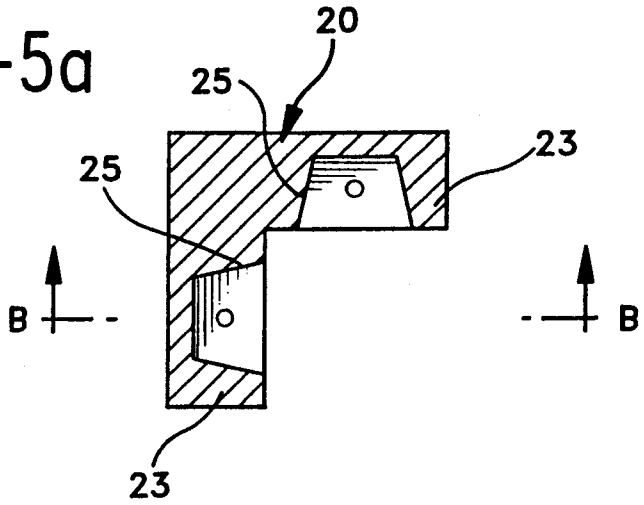
FIG. 5*a* is a sectional view of the corner panel depicted in FIG. 5, taken along lines A—A.
Figure 5:
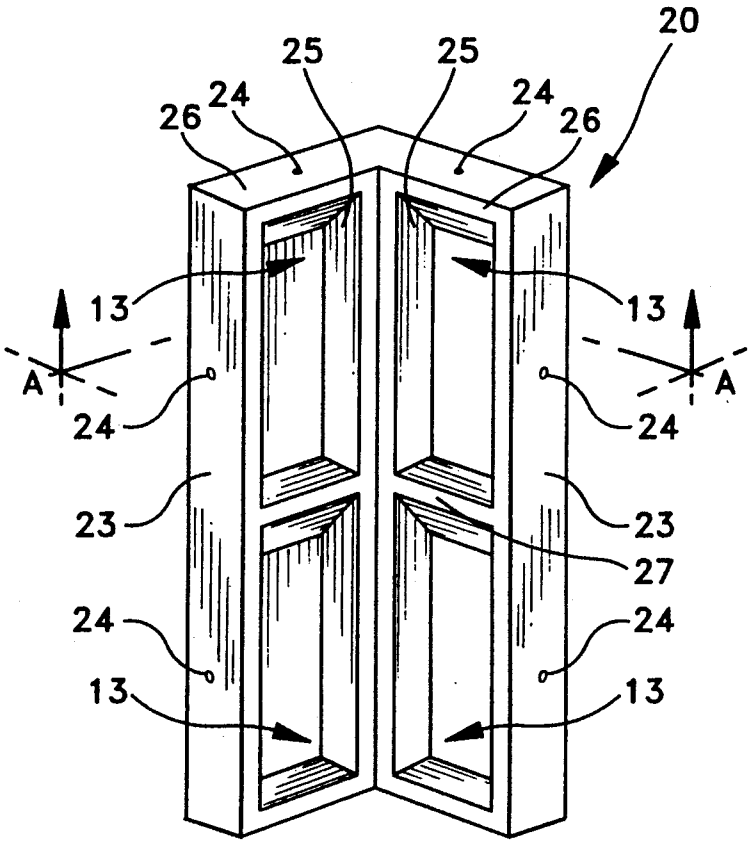
FIG. 5 is a perspective view of the corner panel of this invention.
Figure 6:
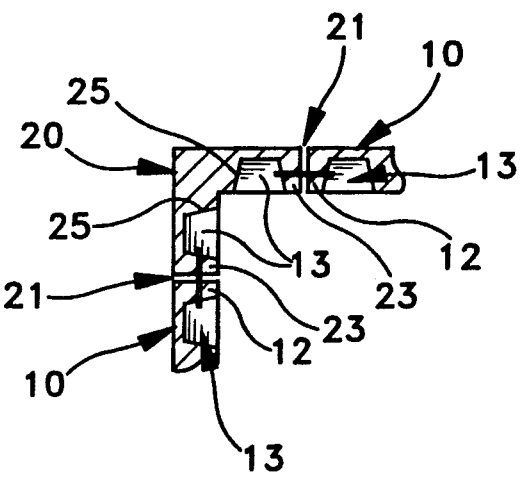
FIG. 6 is a sectional view of a bolt connection for attaching the corner panel illustrated in FIG. 5 with the side panel depicted in FIG. 1.
Figure 5B:
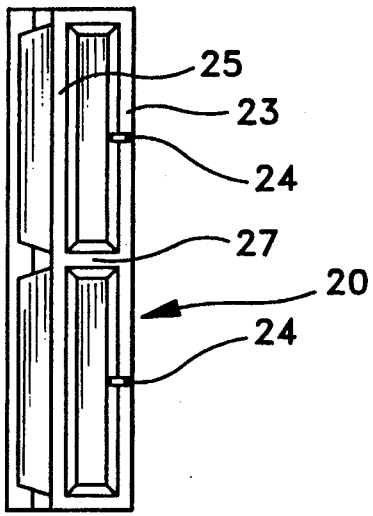
FIG. 5*b* is a sectional view of FIG. 5*a*, taken along lines B—B.

The present invention has fabricated a corner panel 20, illustrated in FIGS. 5, 5*a* and 5*b*. Like side panel 10, the corner panel 20 comprises reinforcement ribs and a skin layer. Peripheral or side ribs 23 have bolt holes 24 for fastening the corner panel 20 to adjacent side panels 10, as is illustrated in FIG. 6, and is shown in an enlarged view of the connection portion in FIG. 2.

Abutting rib 23 (corner panel 20) and rib 12 (side panel 10) are connected by passing a bolt 16 through their respective bolt holes 24 and 14, and fastening nut 17 on either end of the bolt 16.

The corner panel 20 has tapered peripheral ribs 23 and corner ribs 25 to provide trapezoidal-shaped recesses 13 similar to the side panels 10.

The bolt 16 secured by nuts 17 is entirely within the interior framework of these panels as provided by recesses 13. The bolt 16 is entirely supported along its length by ribs 12 and 23, respectively, so a strong connection is provided.

A top rib 26 (FIG. 5) has bolt holes 24 to secure corner panels 20 one-on-top-of-the-other in multi-story construction.

An intermediate rib 27 strengthens the corner panel 25 as well as defines the four recesses 13. It should be clearly evident that the corner panel 20 solves all the prior difficulties of dimensional incrementing, uneven joints, lack of furring strip hanger anchor points, outside nut securement, etc.

Thus having described this invention, what is desired to be protected by Letters Patent is presented by the subsequently appended claims.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A precast waffle corner panel for modular construction of a building, edifice or dwelling, comprising:

a unitary, precast, waffle corner piece having two substantially continguous outer walls joined at a corner angle, and two inner walls each having means defining a reinforcement section having at least one recess, said recess being defined by a side rib and a corner rib, said side rib of each recess, attaching said corner piece to an adjacent side panel, and means defining at least one fastener hole disposed in, and running through, said side rib in each inner wall recess of said corner panel for receiving an elongated fastener for connecting said corner panel to each of said adjacent side panels.

2. The precast waffle corner panel of claim 1, wherein each inner wall has two recesses defined by said side ribs and said corner ribs, and an intermediate rib.

3. The precast waffle corner panel of claim 2, wherein each of said side ribs, corner rib and intermediate rib are tapered to provide trapezoidal-shaped recesses.

4. The precast waffle corner panel of claim 1, wherein said elongated fastener comprises a screw and bolt arrangement.

5. The precast waffle corner panel of claim 1, wherein said recess is further defined by a bottom and top rib, respectively.

6. The precast waffle corner panel of claim 5, wherein said top rib comprises a fastener hole disposed therein and running therethrough to said recess for attaching said corner piece to an adjacent top corner panel.

7. A precast, waffle corner panel for attachment to adjacent waffle side panels in the modular construction of a building, edifice or dwelling, and for particular utilization in constructing foundations thereof, characterized by a recess portion defined by corner and side reinforcement ribs disposed upon an inner section thereof, said side rib having means defining a fastener hole running therethrough which coaligns with a fastener hole disposed in a contiguous side panel, whereby said recess has the dual purpose of providing said corner panel with access to said fastener hole within an inner framework of said corner panel as well as reducing the weight of said corner panel.

8. The precast, waffle corner panel of claim 7, wherein said recess portion comprises at least two recesses.

9. The precast, waffle corner panel of claim 7, wherein said recess portion comprises four recesses.

10. The precast, waffle corner panel of claim 9, wherein each recess has a fastener hole disposed in a side rib.

11. The precast, waffle corner panel of claim 10, wherein two recesses also have a top rib with a fastener hole for attachment of said corner panel to another adjacent corner panel.

12. The precast, waffle corner panel of claim 9, wherein two pairs of said recesses are separated by an intermediate rib disposed therebetween.

13. The precast, waffle corner panel of claim 8, wherein said recesses are tapered to provide a trapezoidal depression.

14. The precast, waffle corner panel of claim 9, wherein said recesses are tapered to provide a trapezoidal depression.

* * * * *